US010337192B2

(12) United States Patent
Dammer et al.

(10) Patent No.: US 10,337,192 B2
(45) Date of Patent: Jul. 2, 2019

(54) SOLID STATE FLOOR LIGHTING UNIT AND SYSTEM

(71) Applicant: SIGNIFY HOLDING B.V., Eindhoven (NL)

(72) Inventors: Henk Albert Dammer, Eindhoven (NL); Ivo Scheringa, Eindhoven (NL)

(73) Assignee: SIGNIFY HOLDING B.V., Eindhoven (NL)

( * ) Notice: Subject to any disclaimer, the term of this patent is extended or adjusted under 35 U.S.C. 154(b) by 0 days.

(21) Appl. No.: 15/531,006

(22) PCT Filed: Nov. 6, 2015

(86) PCT No.: PCT/EP2015/075931
§ 371 (c)(1),
(2) Date: May 26, 2017

(87) PCT Pub. No.: WO2016/087158
PCT Pub. Date: Jun. 9, 2016

(65) Prior Publication Data

US 2017/0321436 A1 Nov. 9, 2017

(30) Foreign Application Priority Data

Dec. 2, 2014 (EP) ..... 14195750

(51) Int. Cl.
*E04F 15/02* (2006.01)
*E04F 15/06* (2006.01)
(Continued)

(52) U.S. Cl.
CPC ..... *E04F 15/06* (2013.01); *E04F 15/02005* (2013.01); *F21V 15/00* (2013.01);
(Continued)

(58) Field of Classification Search
CPC ..... E04F 15/06; E04F 15/02005
(Continued)

(56) References Cited

U.S. PATENT DOCUMENTS 2,377,211 A * 5/1945 Cocken, Jr. ..... E04F 15/06 404/40
3,093,216 A * 6/1963 Dunham ..... E04C 2/08 105/375
(Continued)

FOREIGN PATENT DOCUMENTS

CN 101509622 A 8/2009
DE 9404641 U1 5/1994
(Continued)

*Primary Examiner* — Paola Agudelo

(57) ABSTRACT

A solid state floor lighting unit comprises a printed circuit board carrying an array of solid state lighting elements and a protective cover. The cover has openings or other light output regions aligned with the solid state lighting elements to provide light output. The protective cover has at least one edge with downwardly projecting spaced supporting tabs. These tabs form a comb structure which enables adjacent units to be interlinked. In this way a reduced pitch between lighting elements across the join between units is made possible, but the protective cover still provides the required stiffness and robustness to carry heavy loads.

14 Claims, 3 Drawing Sheets

(51) Int. Cl.

| | |
|---|---|
| ***F21V 33/00*** | (2006.01) |
| ***F21V 15/00*** | (2015.01) |
| ***F21V 21/005*** | (2006.01) |
| *F21Y 105/16* | (2016.01) |
| *F21Y 115/10* | (2016.01) |

(52) U.S. Cl.
CPC ..... *F21V 21/005* (2013.01); *F21V 33/006* (2013.01); *E04F 2290/026* (2013.01); *F21Y 2105/16* (2016.08); *F21Y 2115/10* (2016.08)

(58) Field of Classification Search
USPC ..... 52/28; 362/153
See application file for complete search history.

(56) References Cited

U.S. PATENT DOCUMENTS 5,095,412 A * 3/1992 French ..... E04C 2/521 362/153
6,751,912 B2 6/2004 Stegner et al.
7,487,622 B2 * 2/2009 Wang ..... E04F 13/0862 52/177
8,128,253 B2 * 3/2012 Opitz ..... G02B 6/0011 362/145
8,186,116 B2 * 5/2012 Anderson ..... E01C 5/001 52/181
8,206,002 B1 * 6/2012 Olson ..... B25H 5/00 280/32.6
8,444,287 B2 * 5/2013 Hardesty ..... E04F 15/02166 15/216
8,801,213 B2 * 8/2014 Matsushima ..... H05B 33/02 362/147
8,894,233 B2 * 11/2014 Van Herpen ..... D06N 7/0036 362/153
8,936,374 B1 * 1/2015 Royse ..... F21V 33/006 362/153
8,973,328 B2 * 3/2015 Masanek, Jr. ..... E04F 15/02005 52/394
2005/0166513 A1 8/2005 Vanderhoef
2006/0265987 A1 * 11/2006 Iannone ..... E01C 5/20 52/384
2006/0272252 A1 * 12/2006 Moller, Jr. ..... E01C 5/20 52/384
2006/0283118 A1 12/2006 Moller
2008/0072514 A1 3/2008 Barlow
2009/0147504 A1 * 6/2009 Teeters ..... F21V 23/06 362/153
2010/0257801 A1 * 10/2010 Anderson ..... E01C 5/001 52/391
2010/0307075 A1 * 12/2010 Zampini ..... F21S 2/00 52/173.1
2011/0113713 A1 5/2011 Lui
2011/0120037 A1 5/2011 Barlow
2014/0286039 A1 9/2014 Sigler

FOREIGN PATENT DOCUMENTS

| | | | |
|---|---|---|---|
| DE | 19952469 | A1 | 5/2001 |
| EP | 1933086 | A1 | 6/2008 |
| JP | 2000110332 | A | 4/2000 |
| JP | 2004245920 | A | 9/2004 |
| JP | 2013506068 | A | 2/2013 |
| JP | 2013096129 | A | 5/2013 |

* cited by examiner

SOLID STATE FLOOR LIGHTING UNIT AND SYSTEM

CROSS-REFERENCE TO PRIOR APPLICATIONS

This application is the U.S. National Phase application under 35 U.S.C. § 371 of International Application No. PCT/EP2015/075932, filed on Nov. 6, 2015 which claims the benefit of European Patent Application No. 14195750.6, filed on Dec. 2, 2014. These applications are hereby incorporated by reference herein.

FIELD OF THE INVENTION

This invention relates to floor lighting, namely lighting panels integrated into or provided over a floor structure, to provide upward illumination into a space through a floor covering.

BACKGROUND OF THE INVENTION

Floor lighting arrangements have been proposed, for example based on a circuit board carrying an array of LEDs, for example with a pitch of 12.5 mm. A robust and stiff frame is needed around and over the LED printed circuit boards in order to allow a user to stand over the location of the LED lighting.

Such a frame cannot span the size of a floor area whilst maintain a desired rigidity, so it needs to be formed as an array of frame members. The frame must carry the same loads as a standard floor.

One cost effective solution for the frame design is to provide a folded sheet metal frame, with folded edges all around which bend down towards to the underlying supporting structure, such as a floor. The frame then provides a suspended surface beneath which the LED PCB can be mounted. Openings in the suspended surface enable the LED light to escape and to be projected upwardly.

From an aesthetic point of view, it is desirable to enable a continuous LED pitch across the floor area. The two folded edges which butt together at the join between the frame members have a width of double the material thickness of the frame member. This limits the lowest value of the achievable pitch between LEDs while maintaining a uniform pitch across of the overall area.

CN-101509622 discloses a floor lighting arrangement in the form of a LED display structure. The display structure comprises a circuit board provided with LEDs, and fixed to this circuit board, a bottom case with through holes at locations corresponding to those of the LEDs. Provided over the bottom case is a cover layer having blind holes at locations corresponding to those of the through holes in the bottom case. One such display structure can be connected to another by a latching means that is provided at the sides of the bottom case. The latching means consist of ribs and slots that are shaped such that the ribs of one display structure fit into the slots of another.

EP 1662068 discloses a modular floor design using floor tiles having bent flanges to support the tiles.

The design suffers the problem that to realize the robustness and stiffness, there is a limit to how closely the internal LED array circuits can be brought together. For example, in most situations the sheet metal thickness may be in the range 2.5 mm-3 mm, and this gives a 5 mm to 6 mm space between frame members, not including an additional bend radius of the sheet metal frame member and also a minimum edge dimension between the edge of the PCB and the LEDs at the LED edge.

The design thus limits the ability to reduce the LED pitch, which may be desired either to give a more uniform output or to enable a required light intensity to be achieved.

SUMMARY OF THE INVENTION

The invention is defined by the claims.

According to examples in accordance with an aspect of the invention, there is provided a solid state floor lighting unit, comprising:

a printed circuit board carrying an array of solid state lighting elements;

a protective cover provided over the printed circuit board, comprising a sheet having an array of openings or light output regions aligned with the solid state lighting elements, wherein the protective cover comprises at least one edge having a line of downwardly projecting spaced supporting tabs, and wherein the supporting tabs each have a width along the edge direction which is the same as the space along the edge direction between the tabs.

This tab arrangement provides a comb-type construction in the downward (e.g. folded) edges of the protective cover. The tab design is such that the tabs of one protective cover may fit into the spaces between tabs of an adjacent protective cover. In this way, multiple such units may be interlocked to form an array of units. In this way, it is possible to make a large floor with a continuous array of solid state lighting elements.

The pattern of tabs may be on one side of the protective cover so that two such protective covers can be mounted against each other. More preferably, there are tabs on two opposite edges so that an interlocked line of protective covers can be formed, or else tabs may be on all edges. This enables tessellation of the protective covers.

The design enables the required stiffness and robustness to be maintained, but the interlocking design means there is only one sheet thickness of the supporting line of tabs.

The supporting tabs have a width along the edge direction which is the same as the space along the edge direction between the tabs. This provides a continuous interlocking between adjacent protective covers.

The protective cover may comprise a metal sheet. The tabs can then be formed by mechanical cutting, punching, laser cutting, water beam cutting, or routing/milling. The metal sheet may be aluminum or steel. Non-metal materials may instead be used, such as a plastics material or a carbon fiber reinforced material.

When a metal sheet is used, it may have a thickness in the range 2 mm to 4 mm.

The solid state lighting elements typically comprise LEDs, although other solid state lighting elements may be used.

The array of solid state lighting elements preferably has a uniform pitch in two orthogonal directions, thus forming a regular square grid array. This gives a homogeneous light output. The pitch may be in the range 5 mm to 15 mm, but it may be below 10 mm or it may even be below 5 mm.

This pitch can be maintained across the boundaries between adjacent protective covers.

The protective cover may for example have a rectangular outer shape (which includes the possibility of a square shape), making an easy to tessellate area suitable for a typical rectangular room area. Other shapes which can be tessellated may however be used such as triangles or hexagons.

In the case of a rectangular shape, each of the four edges of the protective cover may comprise a respective line of downwardly projecting spaced supporting tabs. This enables tessellation to form a two dimensional array of units.

The unit preferably further comprises a base plate and an array of pillars between the base plate and the printed circuit board. This provides distributed support for the printed circuit board. In addition, spacers may be provided over the pillars, between the printed circuit board and the protective cover, to provide a solid support between the protective cover and the base plate.

The invention also provides a floor lighting system comprising at least first and second floor lighting units of the invention, wherein the at least one edge of the first floor lighting unit interlocks with the at least one edge of the second floor lighting unit.

The pitch of the solid state lighting elements is preferably uniform across the combined area of the at least first and second floor lighting units.

The invention also provides a floor lighting system comprising a two dimensional array of rectangular floor lighting units of the invention, wherein adjacent edges of the floor lighting units interlock with each other. Again, the pitch of the solid state lighting elements is preferably uniform across the combined area of the two dimensional array of floor lighting units.

BRIEF DESCRIPTION OF THE DRAWINGS

Examples of the invention will now be described in detail with reference to the accompanying drawings, in which.

DETAILED DESCRIPTION OF THE EMBODIMENTS

The invention provides a solid state floor lighting unit, comprising a printed circuit board carrying an array of solid state lighting elements and a protective cover. The cover has openings or light output regions aligned with the solid state lighting elements. The protective cover has at least one edge with downwardly projecting spaced supporting tabs. These tabs form a comb structure which enables adjacent units to be interlinked. In this way a reduced pitch between lighting elements across the join between units is made possible, but the protective cover still provides the required stiffness and robustness to carry heavy loads.

Figure 1:
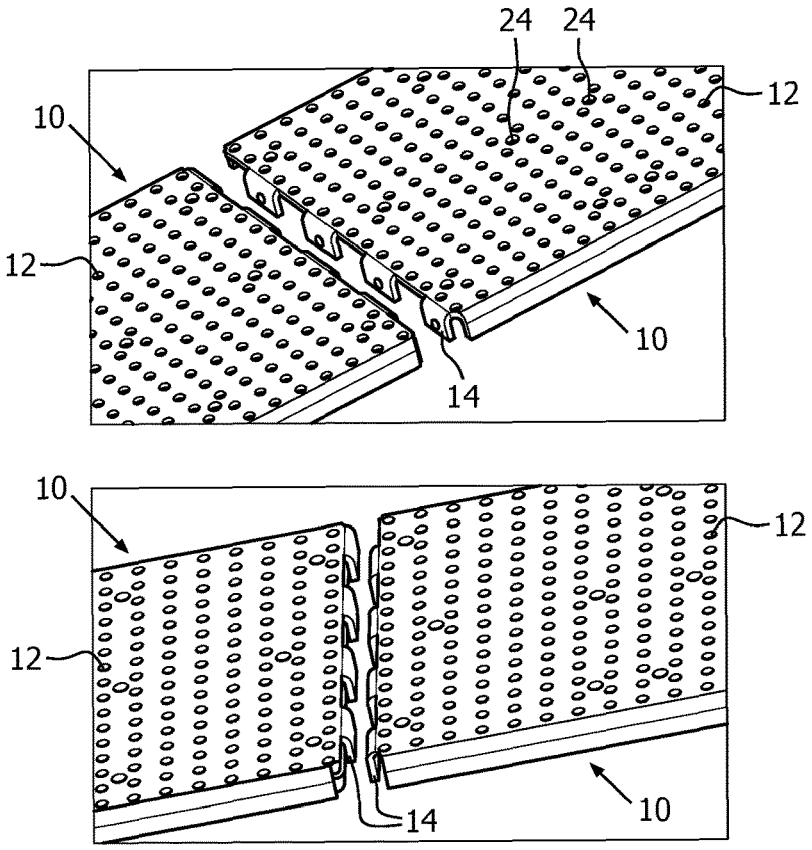
FIG. 1 shows an example of two protective covers for floor panel lighting units for interlocking.

FIG. 1 shows protective covers 10 for two lighting units. Each protective cover is in the form of a sheet having an array of openings 12 which are aligned with solid state lighting elements beneath the cover. Each protective cover has one edge having a line of downwardly projecting spaced supporting tabs 14.

The supporting tabs thus extend in a direction perpendicular to the general plane of the protective cover, and they function as supporting feet on which the protective cover stands, to space the main top surface of the cover from a base level.

In the example shown, the array of openings forms a regular square grid, therefore with an identical pitch in two orthogonal directions.

The edge of one protective cover is designed to mate with the adjacent edge of the other protective cover.

The supporting tabs 14 have a width along the edge direction which is the same as the space along the edge direction between the tabs. This means the tabs of one edge can fit in the spaces between the tabs of the other sheet. In practice the space between tabs needs to be a very small amount larger than the tab width, to enable the interlocking, and the term "same width" should be understood accordingly. It means that when interlocked there is support along the full edge. This also means that the alignment of the LED arrays is guaranteed by the correct alignment of the protective covers of the two units.

To provide this full support and auto-alignment, the tab width is for example no more than 1 mm smaller than the spacing between tabs, and this should be understood to correspond to tab width and tab spacings which are the same. However, full support along the edges (and the automatic alignment benefit) may not be required, depending the thickness of the protective cover and the material used. Preferably, the tabs widths in combination occupy at least 25% of the edge length, so that the tabs from interlocked edges provide support over at least 50% of the length of the edge.

The protective cover may be supported not only at its edges by the tabs 14, but also by spaced pillars 24. These extend beneath the protective cover at locations between the openings 12. The protective cover is fixed to the pillars by screws.

Figure 2:
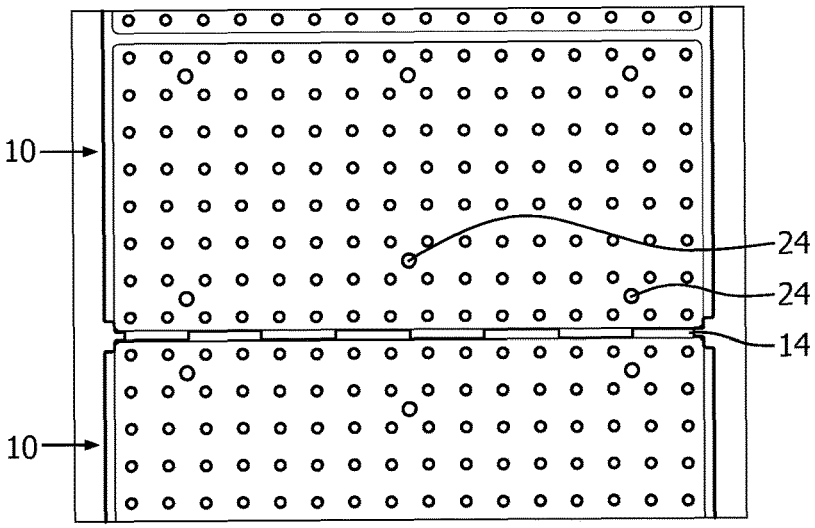
FIG. 2 shows the two protective covers interlocked.

FIG. 2 shows the two protective covers 10 interlocked. The array of openings 12 of each protective cover is designed so that when interlocked, the pitch remains constant across the join. This can be seen in FIG. 2, which shows the automatic alignment feature based on matching tab width and tab spacing.

Note that the pitch may differ in the two orthogonal directions, but again the pitches in these two orthogonal directions remain constant across the join.

The protective covers may be formed as metal sheets, for example with a thickness in the range 2 mm to 4 mm.

The most standard and cost effective way to make sheet metal frames is from a blank. This blank is a flat sheet metal plate and the required shape with cut-outs to form the tabs can be implemented with mechanical cutting or punching, laser cutting or waterbeam cutting. The protective covers may also be made using routing or milling, starting with a solid base material. Different metals may be used such as steel or aluminum. However, non-metal sheets may also be used, such as carbon fiber reinforced materials, or plastics.

Figure 3:
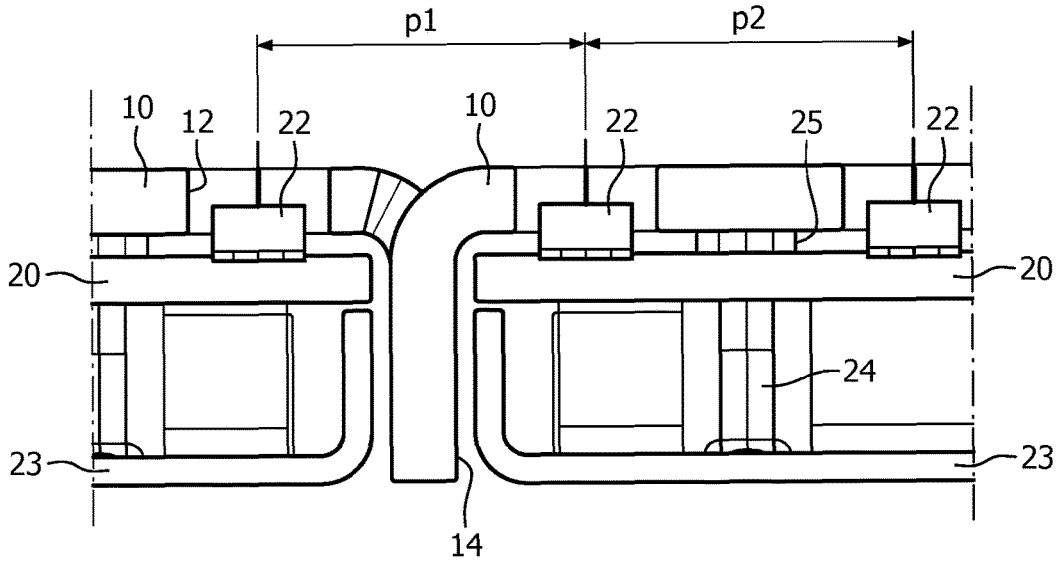
FIG. 3 shows two floor panel lighting units interlocked along a pair of adjacent edges.

FIG. 3 shows two solid state floor lighting units butted together in the manner explained above.

As shown, each unit comprises an LED circuit board 20 on which is provided the array of LEDs 22. The LED circuit board 20 is raised above a base plate 23 by the pillars 24 so that there is space beneath the circuit board for components carried on the underside of the circuit board 20, and/or for other discrete components or wiring. Each unit has the protective cover 10 as described above.

The pillars 24 extend between the circuit board 20 and the base plate 23 to support the circuit board at the desired height. In addition, a spacer 25 is provided above each pillar 24 which sets the required space between the top of the circuit board and the underside of the protective cover 10. This enables load applied to the top of the protective cover to be spread between the tabs and the pillars. The pillars preferably extend as an array across the area of the protective cover.

Each LED 22 projects into a corresponding opening 12 of the protective plate. The tabs 14 ensure the top surface of the protective cover is above the top surface of the LEDs 22. The base of the tabs 14 rests at the level of the bottom of the base plate 23. The protective cover has the required thickness to resist deforming under specified loads (e.g. based on heavy foot traffic) to risk damage to the LEDs or associated circuitry.

The pitch of the LEDs in the direction across the join (i.e. perpendicular to the direction of the edges) is uniform, so that p1=p2.

Figure 4:
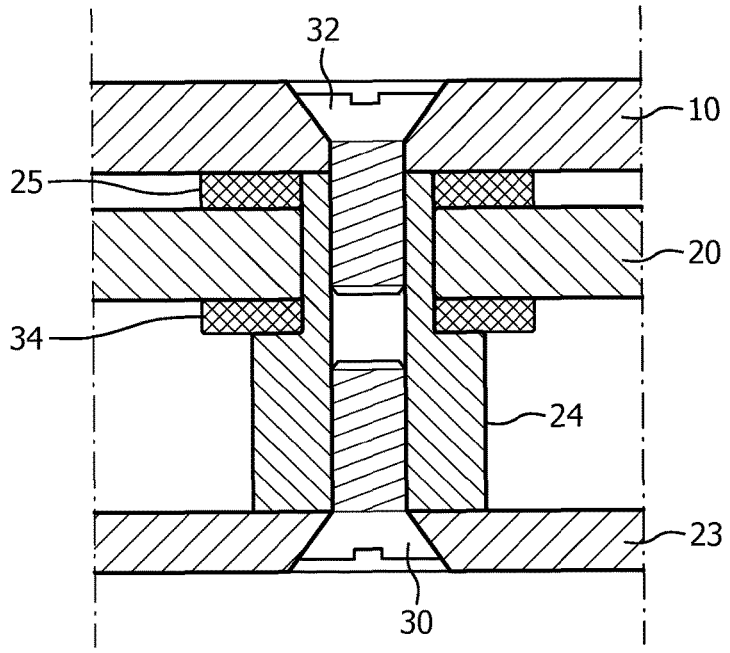
FIG. 4 shows one possible pillar design in more detail.

FIG. 4 shows one example of spacer arrangement in more detail. The pillar 24 has a threaded bore at the top and bottom. A countersunk screw 30 couples the base plate 23 to the threaded bore in the bottom of the pillar, and a countersunk screw 32 couples the protective cover 10 to the threaded bore in the top of the pillar 24. The pillar 24 passes through an opening in the circuit board 20. An upper spacer 25 is provided between the circuit board and the protective cover, and a lower spacer 34 provides a seat for the circuit board 20 over a wider base part of the pillar 24. In this way, the pillar fixes the space dimensions between the cover, the circuit board and the base.

Not all pillars necessarily have the top screws 32 and spacers 25, since less densely packed support of the protective cover may be required than the support of the circuit board. However, it is equally possible for all pillars to be coupled at their top and bottom as shown in FIG. 4.

The example shown has only one pair of interlocking edges, so that two such units can be mated together. The two units may be identical. This is the most simple implementation.

A line of units may be formed by having two opposite edges provided with the tab arrangement.

In practice, it is desirable to be able to tile units to form a two dimensional array. For this purpose, rectangular units may be used, with tab arrangements on all four edges. These may be designed so that all units are identical. The LED pitch is then maintained across the joins in both orthogonal directions of the rectangular array.

Figure 5:
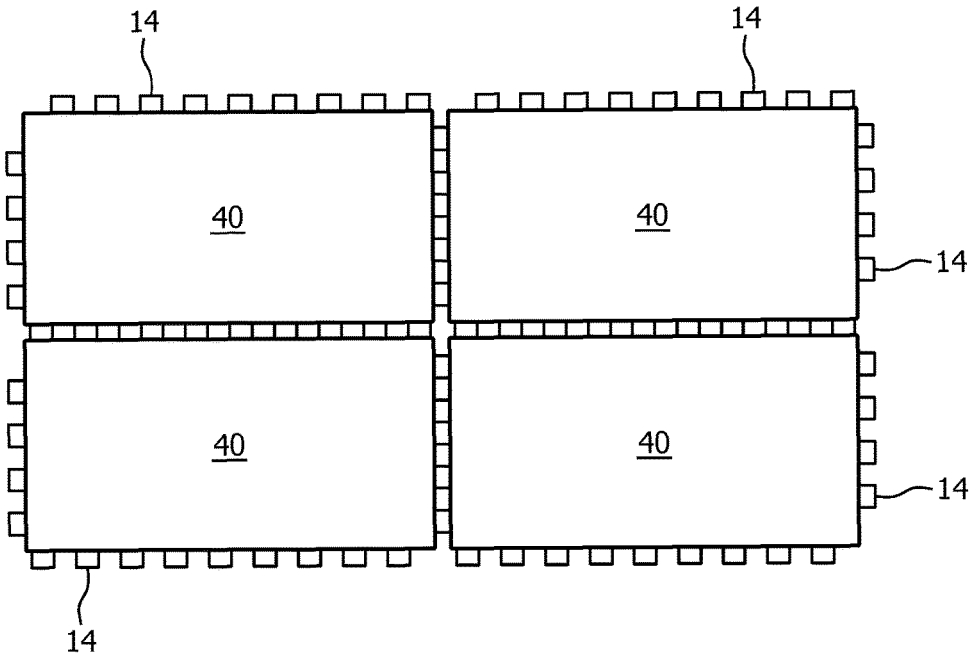
FIG. 5 shows four floor panel lighting units interlocked to form a two dimensional array.

FIG. 5 shows how a two dimensional array may be formed from identical units 40. Each unit has tabs on all four edges, and they interlock between all adjacent pairs of edges to provide support and alignment, while only occupying a width (perpendicular to the edge direction) equal to the thickness of the sheet which forms the protective covers.

By way of example, the units may have dimensions of tens of centimeters, for example 20 cm by 80 cm. The thickness (height) of the overall arrangement may be in the range 10 to 30 mm. The tabs may for example have a width of 10 to 40 mm, for example around 25 mm.

The LED pitch may be 12.5 mm, although the interlocking arrangement enables the pitch to be reduced, for example to below 10 mm, and potentially even lower. The opening over the LEDs are sufficient to allow the light to escape, for example with a diameter in the range 0.5 mm to 2 mm.

The LEDs are preferably low power LEDs for example with a high color temperature (e.g. 6500K).

The units do not have to be rectangular. Preferably a shape is used which can be tessellated such as triangles, hexagons or squares. Furthermore, it is also possible to form a tessellation from different shapes.

As explained above, the combined array of LEDs may have uniform pitch in both orthogonal dimensions, across each unit and across the joins between units. However, this is not essential. The narrow space between units is also of benefit when non-uniform arrays of lighting units are desired, for example to create images or other lighting effects. The ability to place units close together gives additional design freedom both for uniform arrays of lighting elements and for non-uniform arrays of lighting elements.

The lighting elements are preferably LEDs, but the invention can be applied to any solid state lighting elements. The advantage of solid state lighting is the reliability and longevity, which avoids the need to change lighting elements, which in an under-floor lighting system is particularly undesirable.

The lighting units may for example be used as part of an under-carpet lighting system. The system may then be used in conjunction with a specially designed light transmissive carpet. Such carpets are for example manufactured by the company Desso™. The lighting may for example identify emergency exits, provide other information or just provide general lighting.

The protective cover may have a further, transparent layer over the top, to cover the openings, and thereby prevent debris (e.g. dust) entering the volume in which the PCB is housed. In this case, there are light output windows. This layer may implement desired lighting effects, such as color filtering or optical beam shaping (such as beam broadening or beam widening).

The lighting elements may all be the same, but alternatively different type of lighting element may be provided, for example to provide different intensities and/or colors in different areas or to project an image or logo through the floor covering.

The protective cover is typically not transparent (e.g. metal) so that openings are provided over the lighting elements. However, the cover could conceivably be a transparent plastic material in which case the full layer is transparent. In this case there are light output regions over the lighting elements, and the space between these regions may also be transparent.

Other variations to the disclosed embodiments can be understood and effected by those skilled in the art in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measured cannot be used to advantage. Any reference signs in the claims should not be construed as limiting the scope.

The invention claimed is:

1. A solid state floor lighting unit, comprising:

a printed circuit board carrying an array of solid state lighting elements;

a protective cover provided over the printed circuit board, comprising a sheet having an array of openings or light output regions aligned with the solid state lighting elements;

a base plate positioned such that the printed circuit board is situated between the base plate and the protective cover;

an array of pillars, wherein the pillars are situated between the base plate and the printed circuit board and wherein the pillars extend from the base plate to the printed circuit board and not beyond;

wherein the protective cover comprises at least one edge having a line of downwardly projecting spaced supporting tabs, and wherein the supporting tabs each have a width along the edge direction which is the same as the space along the edge direction between the tabs such that the tabs of one protective cover are fitable, in use, into the space between tabs of an adjacent protective cover.

2. A unit as claimed in claim 1, wherein at least two opposite edges of the protective cover each comprise a respective line of downwardly projecting spaced supporting tabs.

3. A unit as claimed in claim 1, wherein the protective cover comprises a metal sheet having an array of openings.

4. A unit as claimed in claim 3, wherein the metal sheet has a thickness in the range 2 mm to 4 mm.

5. A unit as claimed in claim 1, wherein the solid state lighting elements comprise LEDs.

6. A unit as claimed in claim 1, wherein the array of solid state lighting elements have a uniform pitch in two orthogonal directions.

7. A unit as claimed in claim 6, wherein the pitch is below 15 mm, more preferably below 10 mm.

8. A unit as claimed in claim 1, wherein the protective cover has a rectangular outer shape.

9. A unit as claimed in claim 8, wherein each of the four edges of the rectangular protective cover comprises a respective line of downwardly projecting spaced supporting tabs.

10. A floor lighting system comprising a two dimensional array of floor lighting units, each as claimed in claim 9, wherein adjacent edges of the floor lighting units interlock with each other.

11. A system as claimed in claim 10, wherein the pitch of the solid state lighting elements is uniform across the combined area of the two dimensional array of floor lighting units.

12. A floor lighting system comprising at least first and second floor lighting units, each as claimed claim 1, wherein the at least one edge of the first floor lighting unit interlocks with the at least one edge of the second floor lighting unit.

13. A system as claimed in claim 12, wherein the pitch of the solid state lighting elements is uniform across the combined area of the at least first and second floor lighting units.

14. A solid state floor lighting unit, comprising:

a printed circuit board carrying an array of solid state lighting elements;

a protective cover provided over the printed circuit board, comprising a sheet having an array of openings or light output regions aligned with the solid state lighting elements;

a base plate positioned such that the printed circuit board is situated between the base plate and the protective cover; wherein the base plate has a bottom surface distal from the printed circuit board;

wherein the protective cover comprises at least one edge having a line of downwardly projecting spaced supporting tabs that extend downward and terminate at the same level as the base plate's bottom surface; and wherein the supporting tabs each have a width along the edge direction which is the same as the space along the edge direction between the tabs such that the tabs of one protective cover are fitable, in use, into the space between tabs of an adjacent protective cover.

* * * * *